US007105124B2

(12) United States Patent
Choi

(10) Patent No.: US 7,105,124 B2
(45) Date of Patent: Sep. 12, 2006

(54) METHOD, APPARATUS AND PRODUCT FOR MANUFACTURING NANOFIBER MEDIA

(75) Inventor: Kyung-Ju Choi, County of Jefferson, KY (US)

(73) Assignee: AAF-McQuay, Inc., Louisville, KY (US)

( * ) Notice: Subject to any disclaimer, the term of this patent is extended or adjusted under 35 U.S.C. 154(b) by 530 days.

(21) Appl. No.: 09/884,215

(22) Filed: Jun. 19, 2001

(65) Prior Publication Data

US 2002/0192468 A1 Dec. 19, 2002

(51) Int. Cl.
*B29C 47/00* (2006.01)

(52) U.S. Cl. ..... 264/465; 264/11

(58) Field of Classification Search ..... 210/508; 428/359, 78.17, 300.7, 903; 264/115, 24, 264/176.1; 523/61; 521/64, 141; 95/273, 95/280, 487; 425/145
See application file for complete search history.

(56) References Cited

U.S. PATENT DOCUMENTS

| | | | | |
|---|---|---|---|---|
| 3,731,352 | A * | 5/1973 | Okamoto et al. | 28/112 |
| 4,043,331 | A | 8/1977 | Martin et al. | 128/156 |
| 4,044,404 | A | 8/1977 | Martin et al. | 3/19 |
| 4,210,615 | A * | 7/1980 | Engler et al. | 264/11 |
| 4,215,682 | A * | 8/1980 | Kubik et al. | 128/205.29 |
| 4,266,918 | A | 5/1981 | Manley | 425/66 |
| 4,323,525 | A | 4/1982 | Bornat | 264/24 |
| 4,639,390 | A | 1/1987 | Shoji | 428/195 |
| 4,657,793 | A | 4/1987 | Fisher | 428/36 |
| 4,663,358 | A * | 5/1987 | Hyon et al. | 521/64 |
| 4,842,505 | A | 6/1989 | Annis et al. | 425/174.8 E |
| 5,522,879 | A | 6/1996 | Scopelianos | 623/1 |
| 6,106,913 | A | 8/2000 | Scardino et al. | 428/36.3 |
| 6,110,590 | A | 8/2000 | Zarkoob et al. | 428/364 |
| 6,214,331 | B1 * | 4/2001 | Vanderhoff et al. | 424/78.17 |
| 6,265,333 | B1 * | 7/2001 | Dzenis et al. | 442/346 |
| 6,472,470 | B1 * | 10/2002 | Fujiwara et al. | 525/61 |
| 6,520,425 | B1 * | 2/2003 | Reneker | 239/294 |
| 6,592,623 | B1 * | 7/2003 | Bowlin et al. | 623/14.13 |
| 6,608,116 | B1 * | 8/2003 | Symons et al. | 521/134 |
| 6,608,117 | B1 * | 8/2003 | Gvozdic | 521/141 |
| 6,645,407 | B1 * | 11/2003 | Kellenberger et al. | 264/115 |
| 6,645,618 | B1 * | 11/2003 | Hobbs et al. | 428/359 |
| 6,673,136 | B1 * | 1/2004 | Gillingham et al. | 95/273 |
| 6,689,374 | B1 * | 2/2004 | Chu et al. | 424/423 |
| 6,713,011 | B1 * | 3/2004 | Chu et al. | 264/465 |
| 6,716,264 | B1 * | 4/2004 | Onoda | 55/385.3 |
| 6,753,311 | B1 * | 6/2004 | Fertala et al. | 514/2 |
| 6,924,028 | B1 * | 8/2005 | Chung et al. | 428/357 |

OTHER PUBLICATIONS

Doshi, Jayesh Natwarlal, The Electospinning Process and applications of Electrospun Fbers, PhD Thesis, 8, 1994.*

"Development of Non-Wovens for Protecting Clothing' Nano Fiber Membrane Example," by P. Gibson et al, published on 9th Annual TANDEC Nonwovens Conference, Nov. 10-12, 1944 by the U.S. Army Soldier Systems Center, Natick, MA.

* cited by examiner

*Primary Examiner*—Ana Fortuna
(74) *Attorney, Agent, or Firm*—Steve A. Witters; Middleton Reutlinger

(57) ABSTRACT

A unified arrangement for providing a unique nanofibrous porous media formed as a chemical compound from a water-soluble polymer combined with a cross-linking agent with a balance of water, which chemical compound prevents the polymer from dissolving in water, including a humid environment.

23 Claims, 3 Drawing Sheets

METHOD, APPARATUS AND PRODUCT FOR MANUFACTURING NANOFIBER MEDIA

CROSS-REFERENCE TO RELATED APPLIATIONS

Not Applicable

STATEMENT REGARDING FEDERALLY

Not Applicable

SEQUENCE LISTING

Not Applicable

BACKGROUND OF THE INVENTION

The present invention relates to a unified method, apparatus and product arrangement for producing nanofiber filaments and more particularly, to such an arrangement for producing organic filter media nanofibers.

It is well known in fiber manufacture to produce extremely fine fibrous materials of organic fibers, attention being directed to U.S. Pat. No. 4,043,331 and U.S. Pat. No. 4,044,404, issued to G. E. Martin et al on August 23 and August 30, respectively, wherein a fibrillar mat product is prepared by electrostatically spinning an organic material and subsequently collecting spun fibers on a suitable surface; U.S. Pat. No. 4,266,918, issued to R. S. Manley on May 12, 1981, wherein a controlled pressure is applied to a molten polymer which is emitted through an orifice of an energy charged plate; and, to U.S. Pat. No. 4,323,525, issued to A. Bornat on Apr. 6, 1982, wherein a water soluble polymer is fed by a series of spaced syringes into an electric field including an energy charged metal mandrel having a sheath of aluminum foil wrapper therearound which may be coated with PTFE (Teflon™) release agent. Attention is further directed to U.S. Pat. No. 4,044,404, issued to G. Ernest on Aug. 30, 1977, U.S. Pat. No. 4,639,390, issued to R. Shoji on Jan. 27, 1987; U.S. Pat. No. 4,657,743, issued to A. C. Fisher on Apr. 14, 1987; U.S. Pat. No. 4,842,505, issued to D. Annis et al on Jun. 27, 1989; U.S. Pat. No. 5,522,879, issued to A. G. Scopelianos on Jun. 4, 1996, U.S. Pat. No. 6,106,913, issued to F. L. Scardino et al on Aug. 22, 2000; and, U.S. Pat. No. 6,111,590, issued to S. Zarkoob et al on Aug. 29, 2000—all of which use polymer nanofiber production arrangements. Finally, attention is directed to the nanofiber polymer spinning article entitled, "Development of Non-wovens for Protective Clothing: "Nanofiber Membrane Example", by P. Gibson et al, published on 9$^{th}$ Annual TANDEC Nonwovens Conference, Nov. 10–12, 1999 by the U.S. Army Soldier Systems Center, Natick Mass.

In all of the above prior art, none—either alone or in combination—recognizes let alone teaches, the novel, unified electro-spinning method, apparatus and product arrangement hereinafter set forth. In accordance with the present invention, it is recognized that solvent recovery is a most critical issue, since solvents for most polymers are organic and harmful. Moreover, the fiber tensile strength has proven to be very low with the produced fibers dissolving in water, including environmentally humid conditions. The continuous, uninterrupted manufacturing process of elecrospinning is an important feature of the present invention. A further feature of the present invention is to provide for uniform coverage across a full width of a product through the novel usage of multiple capillary tubes. To further increase production output, the present invention recognizes the advantages of manufacturing tubular capillary tubes with sharp plural outlet tips and with the application of heat surrounding the capillary tubes to further improve output. The present invention, recognizing these past problems in the electro-spinning of water soluble polymeric material, provides a unique arrangement wherein nanofibers can be significantly reduced to very thin cross-sectional areas and yet be produced under unique alternative pressure steps, resulting in a comparatively stronger and more flexible nanofibers. The nanofibers produced by the unique electro-spinning arrangement of the present invention allow for a safe environment with the produced nanofibers being comparatively stronger and having good adhesion and flexibility when mounted to a substrate, allowing for a minimum increase of pressure drop across the manufactured product. In addition, products produced by the unique electro-spinning arrangement of the present invention maintain a comparatively high porous integrity with such lower pressure drop, resulting in higher product efficiency—particularly of significance in the environmental fluid filtration arts. The unique properties of fibers are arrived at in the present invention by combining selected greater portions by weight of water soluble polymers with a selected lesser portion by weight of cross-linkable agent capable of forming three dimensional structural unit molecules with the balance by weight being water. In accordance with the present invention, a selected acid can be added to increase the rate of chemical cross-linking. In addition, heat or ultra violet (UV) light can be applied to enhance cross-linking reaction as the nanofibers are formed. In some selected instances the novel nanofibers can be collected on an acid-water soaked substrate.

Various other features of the present invention will become obvious to one skilled in the art upon reading the disclosure set forth herein.

BRIEF SUMMARY OF THE INVENTION

More particularly, the present invention provides a unique and novel unified arrangement which includes: a method of forming nanofibrous media strands comprising: chemically combining a greater portion by weight of a water-soluble polymer with a lesser portion by weight of a cross-linking chemical agent into a chemical combination capable of preventing the polymer of said water-soluble polymer from dissolving in water, including an ambient humid environment; spinning the chemical combination at selected high energy to form very thin spun nanofiber strands of sufficient strength and flexibility to permit product shaping; and, collecting the spun strands on a selected substrate. In selected instances, a lesser portion by weight of an acid can be added to increase the rate of chemical cross-linking. Further, heat of ultraviolet light can be applied to enhance cross-linking reaction as the nanofiber strands are formed.

In addition, the present invention provides a unique apparatus for forming such nanofibrous media comprising: storage means to receive the fiber forming chemical compound including at least one storage inlet to receive the nanofiber forming compound and at least one valved outlet; pumping means having at least one pumping inlet communicably connected to the valved outlet of the storage means to receive the nanofiber forming compound, the pumping means having at least one pump inlet and at least one pump outlet from which the nanofiber forming compound received by the pumping means can be pumped as at least one stream under selected pressure; energy conductive capillary means having at least one inlet to receive the nanofiber forming compound stream from the pumping means and at least one outlet to emit the nanofiber stream as a thin further reduced fiber stream of selected cross-sectional area with energy generating means connected to the energy conductive capillary means to apply a selected energy charge to the capillary means; insulating means positioned between said pumping means and the capillary means to insulate the fiber stream as it passes from the pumping means to the capillary means; and, collecting means to receive the nanofibers from the capillary means.

Finally, the present invention provides a unique and unified nanofiber media compound arrangement comprised of a greater portion by weight of a water-soluble polymer and a lesser portion by weight of a cross-linking chemical agent with the balance by weight being water, the combination being selected to prevent the polymer of the water-soluble polymer from dissolving in water, including an ambient humid environment. If elected, a lesser portion by weight of an acid may be added to the compound to increase rate of cross-linking. Further, heat and/or ultraviolet light may be applied to enhance cross-linking reaction as the nanofibers are formed. Moreover, the nanofibers may be collected on an acid-water soaked substrate.

It is to be understood that various changes can be made by one skilled in the art in one or more of the several steps, parts and materials described herein without departing from the scope or spirit of the present inventive method, apparatus and product, respectively described herein.

DETAILED DESCRIPTION OF THE DRAWINGS

Referring to the drawings which disclose several advantageous embodiments of the present invention:

Figure 3A:
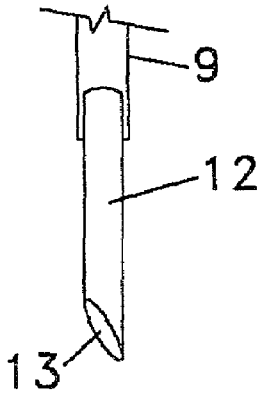
Figure 3B:
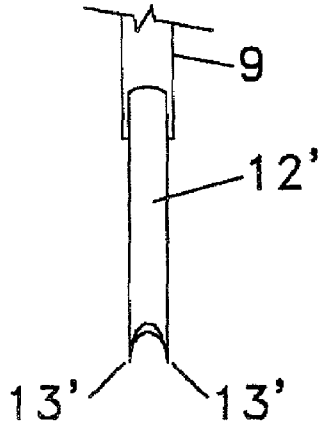
Figure 3C:
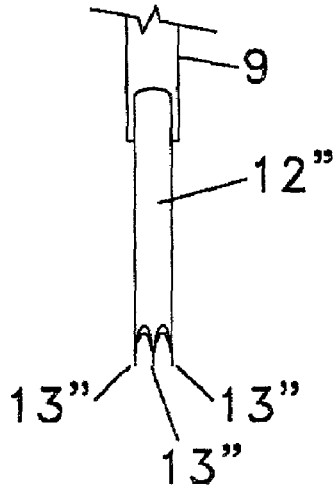
Figure 4:
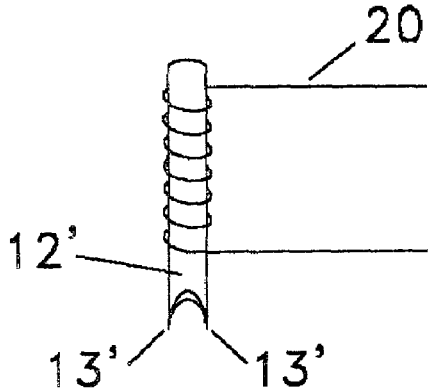

FIGS. 3A, 3B and 3C disclose somewhat enlarged views of three types of novel capillary tube tips which may be employed to increase output; and, FIG. 4 discloses a heating arrangement for the capillary tube of FIG. 3B.

DETAILED DESCRIPTION OF THE INVENTION

Figure 1:
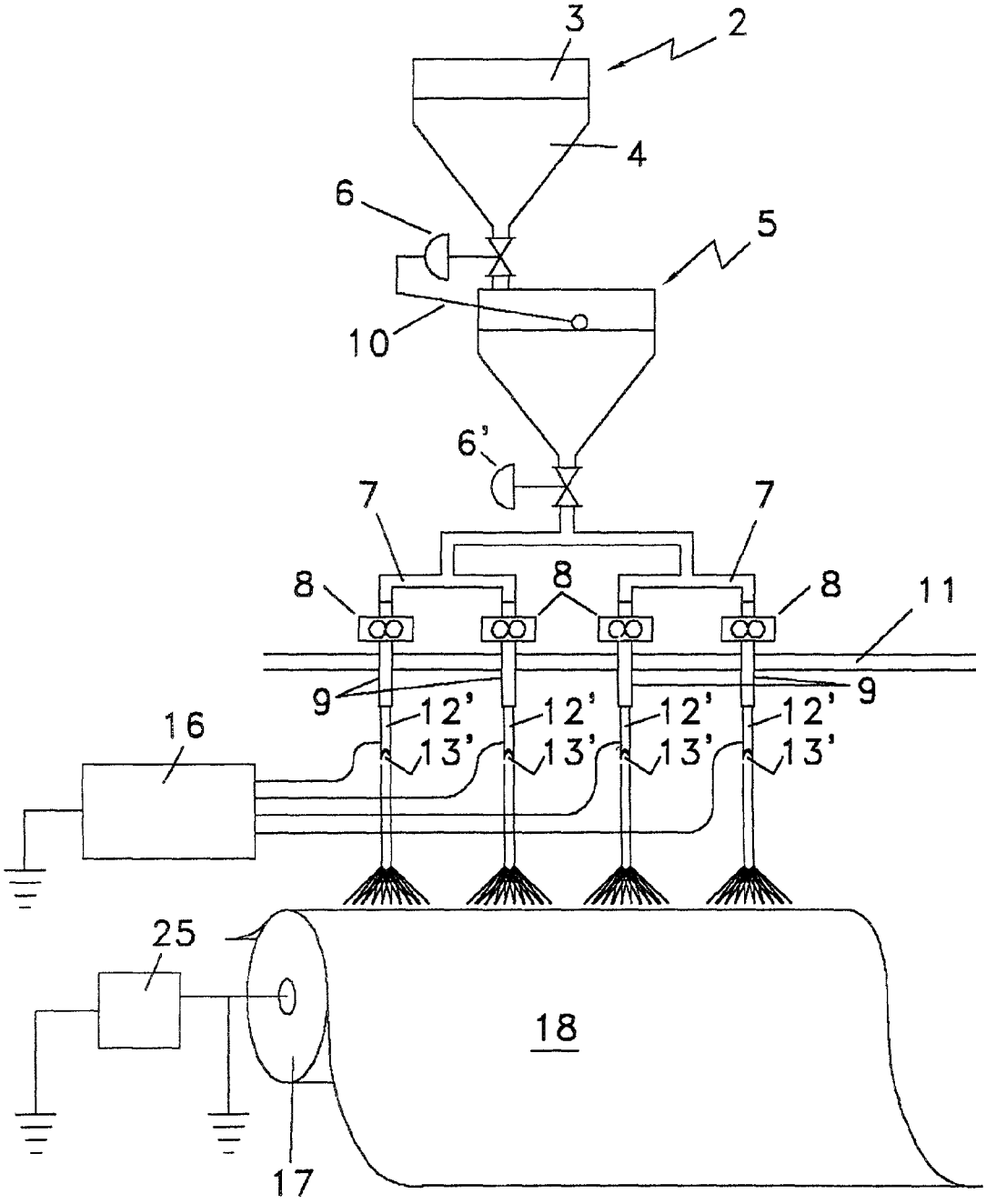
FIG. 1 is a vertically extending schematic plan view of one unique and novel arrangement of apparatus which may be employed to carry out the present invention.
Figure 2:
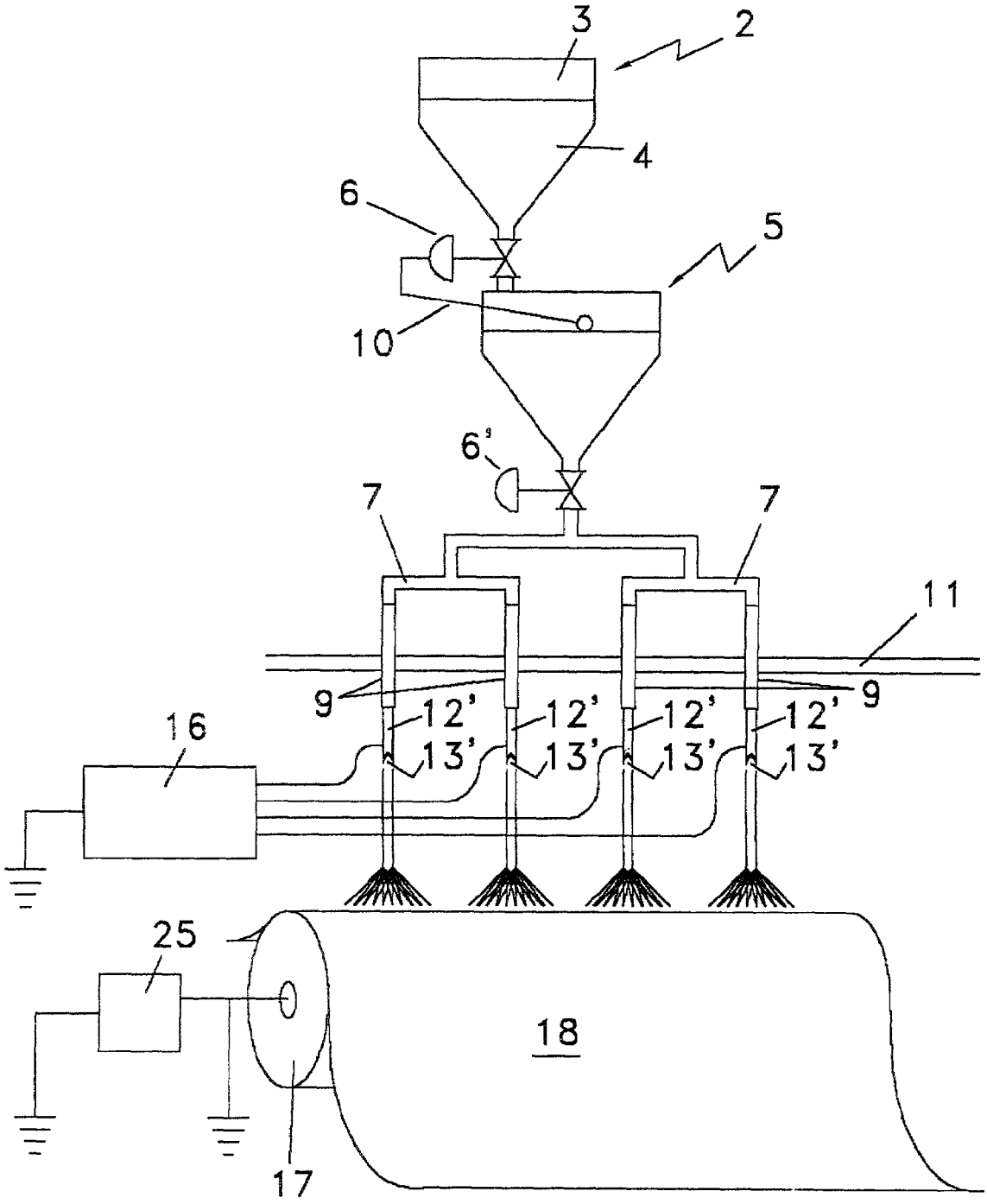
FIG. 2 is a vertically extending schematic plan view, similar to the view of FIG. 1 of another unique and novel arrangement which may be employed to carry out present invention.

In FIG. 1 of the drawing, there is disclosed a longitudinally extending, vertical storage tank 2 which can have a selected capacity in accordance with the novel product to be manufactured. Storage tank 2 which can be formed from any one of a number of suitable liquid impervious materials, such as polyethylene or nylon, can be of cylindrical shape to extend with its longitudinal axis in a supported, substantially vertical position. Storage tank 2 includes a material inlet 3 at the upper portion thereof and, a downwarly necking truncated lower portion 4, having a valved outlet 6 of selected internal cross-section capable of emitting a fluid stream therefrom at a selected volumetric rate. Typically, storage tank 2 can have an internal capacity in the approximate range of fifty (50) to twenty thousand (20,000) cubic centimeters and advantageously two thousand (2,000) cubic centimeters. In FIGS. 1 and 2, where four (4) capillary tubes are utilized, valved outlet 6 can be controlled to emit a fluid stream in the approximate range of zero point zero two four (0.024) to eighty (80) cubic centimeters per minute and advantageously two point four (2.4) cubic centimeters per minute. The viscosity of such fluid stream desirably can be in the approximate range of as low as one (1) to one hundred thousand (100,000) poise and advantageously at approximately two hundred eighty (280) poise. A longitudinally extending, vertical pressure leveling tank 5, similar to tank 2 is positioned therebelow. Tank 5 includes a level switch 10 which is connected to valve outlet 6'. This arrangement controls the amount of material fed from storage tank 4 to leveling tank 5 and thus the material pressure therebelow. A suitable control valve 6' is positioned below leveling tank 5.

A plurality of spaced suitable plastic tubings 7 are each connected at one end to valved outlet 6' of pressure leveling tank 5 and at the opposite end to one of a set of several spaced pumps 8 positioned below valved outlet 6'. In an alternative embodiment of the present invention (FIG. 2), pumps 8 electively can be eliminated, depending on control of leveling tank 5 to maintain a preselected material pressure.

In accordance with the present invention (FIG. 1), each pump 8 can be of a gear type, serving to further stir and reduce the material received thereby and to further reduce the fluid stream emitted therefrom. In the present invention, each fluid stream emitted therefrom can be in the approximate range of zero point zero zero eight (0.008) to twenty point zero (20.0) cubic centimeters per minute and advantageously zero point six (0.6) cubic centimeters per minute with the emitted fluid pressure of the stream being slightly higher than atmospheric pressure. A set of suitable vertically extending electrical insulating tubings 9 are provided to surround each of the fluid streams which are emitted from gear pumps 8. These insulating tubings 9, which can be of energy insulating plastic, are arranged to extend through a horizontally extending sheet 11 of electrically insulating material such as polytetrafluroeythylene (PTFE—Teflon™). The lower end of each tubing 9 (FIG. 3A) surrounds the upper portion of each of a set of spaced electrically conductive capillary tubes 12', each capillary tube 12' having at least (FIG. 3A) one sharp tapered tip 13 (FIGS. 1 and 2 each showing two tips 13') being formed from any one of a number of suitable electrically conductive materials such as copper, silver or stainless steel. Each capillary tube 12' with sharp tapered tips 13' is provided with an upper inlet to receive one of the fluid streams emitted from each of spaced gear pumps 8. The inner diameter of the lower outlet of each capillary tube 12' is internally sized in the approximate range of zero point one (0.1) to three (3) millimeters. As can be seen in FIGS. 3B and 3C, the capillary tubes 12' and 12" are shown as provided with two tips 13' and four tips 13", respectively, with the diameter of each tip being in the approximate range of zero point one (0.1) to three (3) millimeters. Each electrically conductive capillary tube 12' with sharp tapered tips 13' of FIG. 1 is electrically connected to a high voltage electrical generator 16 capable of applying high voltages to each capillary tube with sharp tapered tip 13' in the approximate range of three (3) to one hundred (100) kilovolts and advantageously approximately fifteen (15) kilovolts. Further, and as can be seen in FIG. 4, an electrical heating coil 20 can be provided to surround tube 12' so as to warm tube 12' to approximately sixty (60) degrees centigrade (° C.) to reduce the surface tension.

Suitably positioned below the spaced set of capillary tubes 12' with sharp tapered tip, 13' to receive the very fine spaced nanofibers emitted therefrom being in the approximate range of zero point one (0.1) to three (3) millimeters is a motor driven, grounded cylindrical drum 17. Drum 17, which can be formed from any one of a number of suitable materials such as copper or stainless steel, can be provided with a suitable porous mat 18 of suitable materials such as porous paper or fiberglass in sheet form which can be movably passed thereover to receive the nanofiber webs from the set of capillary tubes 12' with sharp tapered tips 13'. It is to be understood that the core of drum 17 can be oppositely charged from generator 16 by a suitable generator 25 if so desired.

It is further to be understood that the inventive arrangement of the aforedescribed storage tank, pump set, capillary tubes with sharp tapered tip or tips and collector structure can be varied in structural form, size and pressures by one skilled in the art without departing from the novel scope of the present unique arrangement described herein above. In this regard and as can be seen in FIG. 2 of the drawings, and as aforenoted, in another embodiment of the present invention, gear pumps 8 can be eliminated, with the material pressure being controlled entirely by leveling tank 5 and leveling switch 10.

With the inventive arrangement of apparatus as above-described, the unique and novel method of producing a nanofiber strand product, such as filter media suitable for fluid filtration can include chemically compounding a compound of a greater portion by weight of approximately three (3) to fifty (50) percent of a water-soluble polymer such as polyvinyl alcohol with a lesser portion by weight of a cross-linking chemical agent of approximately zero point one (0.1) to twenty (20) percent and advantageously two (2) percent by weight in water with the balance by weight being pure or acidic water. The cross-linking chemical agent advantageously forms three dimensional submicroscopic structural molecules which prevent the polymer of the greater portion of the water-soluble polymer from dissolving in water, including ambient humid environment. Advantageously, the lesser portion by weight of a cross-linking chemical agent can be a selected chemical such as one of the di-aldehydes; namely, Glyoxal ($C_2H_2O_2$), Glutaraldehyde ($C_5H_8O_2$) or one of the acids; namely Maleic acid ($C_4H_4O_4$) or Borax ($B_4N_{a2}O_2$). Further, a selected acid, such as phosphoric acid, can be added in order to increase the rate of cross-linking process. Heat or ultra violet (UV) light can be applied to enhance cross-linking reaction as the nanofibers are formed. In some instances, the nanofibers can be collected on an acid-water soaked substrate.

With selected quantities of either of such chemical combinations in a storage zone, such as storage tank 2, selected quantities thereof can then be passed to a pumping zone; the pumping zone disclosed including, (FIG. 1) or not including (FIG. 2),the set of spaced gear pumps 8. From the pumping zone, selected quantities of the chemical compound can be passed through suitable plastic tubing 7 surrounded by insulating material such as insulating tubes 9 through a porous electrically insulated zone, hereabove described as PTFE sheet 11. The fluid streams are passed into a capillary tube feeding zone in the form of spaced capillary tubes 12' with sharp tapered tips 13'. Capillary tubes 12' are charged by high voltage generation in the approximate voltage range of three (3) to one hundred (100) kilovolts and advantageously fifteen (15) kilovolts. In the present invention, each fluid stream emitted from a capillary tube 12' can be in the approximate range of zero point zero zero eight (0.008) to twenty (20) cubic centimeters per minute and advantageously zero point six (0.6) cubic centimeters per minute with the emitted fluid pressure of the stream being slightly higher than atmospheric pressure. The nanofiber filter threads are collected on a filter media collector zone substrate such as a selected porous sheet of paper or porous fiberglass sheet 18 movably mounted on motor driven collector drum 17.

The inventive formed nano fiber media comprises chemically compounding a compound of a greater portion by weight of approximately three (3) to fifty (50) percent of water-soluble polymer such as polyvinyl alcohol with a lesser portion by weight of a cross-linking chemical agent of approximately zero point one (0.1) to twenty (20) percent and advantageously two (2) percent by weight in water with the balance by weight being pure or acidic water. The cross-linking chemical agent advantageously forms three dimensional submicroscopic structural molecules which prevents the polymer of the greater portion of the water-soluble polymer from dissolving in water, including an ambient humid environment. Advantageously, as above described, the lesser portion by weight of a cross-linking chemical agent can be a selected chemical such as di-aldehydes; namely Glyoxal ($C_2H_2O_2$) or Glutaraldehyde ($C_5H_8O_2$) or acids; namely Maleic acid ($C_4H_4O_4$) or Borax ($B_4N_{a2}O_2$). A selected acid, such as phosphoric acid, can be added in order to increase the rate of cross-linking process. Heat or ultra violet (UV) light can be applied to enhance cross-linking reaction as the nanofibers are formed. In some case, these nanofibers can be collected on an acid-water soaked substrate.

The size of the nanofibers advantageously can have a range from thirty (30) to one thousand (1,000) nanometers and advantageously one hundred fifty (150) nanometers formed as a filter mat by itself or with a porous filter substrate of either another fiber, which also can be of a different nano fibers—or a porous paper, each of selected thickness.

The invention claimed is:

1. A method of forming media strands comprising:

compounding a greater portion by weight of a water-soluble polymer with a lesser portion by weight of a selected cross-linking chemical agent with remainder by weight being water to form a combined compound capable of preventing the water-soluble polymer from dissolving in water including an ambient humid environment;

electrospinning said compound from at least one capillary tube, wherein each of said at least one capillary tubes has at least two sharp tapered tips and each of said at least one capillary tubes has a diameter in the approximate range of 0.1 mm to 3 mm, wherein said electrospinning is conducted at a pre-selected high voltage to emit nanofibers of sufficient strength and flexibility to permit media shaping; and, collecting said nanofibers on a selected substrate.

2. The method of forming media strands of claim 1, wherein said water-soluble polymer comprises approximately 3% to 50% of said combined compound and said selected cross-linking chemical agent comprises a dialdehyde in a range of approximately 0.1% to 20% of the total compound with the balance by weight being water.

3. The method of forming media strands of claim 1, wherein said water-soluble polymer comprises approximately 3% to 50% of said combined compound, said selected cross-linking chemical agent comprises approximately 0.1% to 20% of said compound, and said compounding has the additional step of adding an acid, the balance by weight of said compound being water.

4. The method of forming media strands of claim 1, wherein said compound is in liquid form.

5. The method of forming media strands of claim 2, wherein said compound liquid is cross-linked in acidic condition.

6. The methud of forming media stands of claim 1, wherein said cross-linking chemical agent is Glyoxal ($C_2H_2O_2$).

7. The method of forming media strands of claim 1, wherein said cross-linking chemical agent is Glutaraldehyde ($C_5H_8O_2$).

8. The method of forming media strands of claim 1, wherein said cross-linking chemical agent is Maleic acid ($C_4H_4O_4$).

9. The method of forming media strands of claim 1, wherein said cross-linking chemical agent is Borax ($B_4Na_2O_7$).

10. The method of forming media strands of claim 1, wherein said water-soluble polymer is polyvinyl alcohol.

11. The method of forming media strands of claim 1, wherein said cross-linking agent forms three dimensional submicroscopic structural molecules.

12. The method of forming media strands of claim 1, wherein said electrospinning high voltage is in the approximate range of 3 to 100 kilovolts.

13. The method of forming media strands of claim 12, wherein said electrospinning high voltage advantageously is approximately 15 kV.

14. The method of forming media strands of claim 1, wherein said electrospinning includes passing said combined compound from a storage zone to a pumping zone; pumping said material through an electrically insulated zone to a high voltage capillary feeding zone to emit media strands within selected fiber emission rate ranges; and, passing said emitted fibers to a substrate in a collecting zone.

15. The method of forming media strands of claim 14, wherein said emitted media strands are nanofibers being emitted at an emission rate from each of said at least one capillary tubes in the approximate range of 0.008 to 20 cubic centimeters per minute.

16. The method of forming media strands of claim 15, wherein said emitted media strands are nanofibers being emitted at an emission rate of about 0.6 cubic centimeters per minute.

17. The method of forming media strands of claim 14, wherein said electrically insulated zone includes porous insulating material of polytetrafluroethylene.

18. The method of forming media strands of claim 14, wherein said substrate is movably mounted on a grounded collector.

19. The method of forming media strands of claim 1, wherein said strands are warmed by a heating source at approximately 60° C. to reduce surface tension.

20. A method of forming nano fiber filter media comprising:

combining approximately 3% to 50% of a polymer having polyvinyl alcohol with a cross-linking chemical agent in a range of approximately 0.1% to 20% of the total compound with the balance by weight being water forming a three dimensional submicroscopic structural molecules preventing said polymer from dissolving in water including partial dissolution in an ambient humid environment;

stating selected quantities of said combined compound in a storage zone;

passing said selected quantities of said combined compound at controlled pressure to a pumping zone including a set of spaced parallel fine gear pumps arranged to pump fine streams of filter media strands surrounded by spaced insulating material through a porous electrically insulated zone having polytetrafluroethylene into a high voltage capillary feeding zone having spaced metal capillary tubes, wherein each of said metal capillary tubes has at least two sharp tapered tips and is charged by high voltage generation in the voltage range of 3 kV to 100 kV so as to emit nanofiber filter strands from each of said at least one capillary tubes wherein each of said at least one capillary tubes has a diameter in the approximate range of 0.1 mm to 3 mm and said nanofiber filter strands are emitted from each of said at least one capillary tubes at a volume in the range of 0.008 to 20 cubic centimeters per minute; and, passing said nanofiber filter strands from said source to a porous filter media substrate such as a selected porous paper sheet moveable, mounted on a grounded rotatable drum in a collector zone.

21. A method of forming media strands comprising:

compounding a greater portion by weight of a water-soluble polymer with a lesser portion by weight of a selected cross-linking chemical agent with the remainder by weight being water to firm a combined compound capable of preventing the water-soluble polymer from dissolving in water including an ambient humid environment;

electrospinning said compound through at least one capillary tube wherein each of said at least one capillary tube has at least two sharp tapered tips, said compound maintained at selected high voltage to emit nanofibers of sufficient strength end flexibility to permit media shaping; and, collecting said nonofibers on a selected substrate, wherein the voltage is in the approximate range of 3 to 100 kV, wherein said combined compound comprises approximately 3% to 50% by weight of the water soluble polymer and said cross-linking chemical agent comprises approximately 0.1% to 20% of the compound by weight and said cross-linking chemical agent has a chemical agent selected from the group consisting of an acid, a dialdehyde, end combinations thereof, with the balance by weight of said compound being water.

22. A method of making media strands comprising:

compounding a water soluble polymer with a lesser portion of a cross-linking chemical agent in a water containing solution forming a compound; and electrospinning said compound through at least one capillary tube, each of said at least one capillary tube has at least two sharp tapered tips, said compound forming said media strands is electrospun through each of said at least one capillary tube at a rate in the range of approximately 0.008 to 20 cubic centimeters per minute.

23. A method of making media strands comprising:

compounding a water soluble polymer with a lesser portion of a cross-linking chemical agent in a water containing solution forming a compound; and electrospinning said compound from at least one capillary tube wherein each of said at least one capillary tube has at least two sharp tapered tips, said at least one capillary tube having a diameter in the approximate range of 0.1 mm to 3 mm forming said media strands.

* * * * *